US005824369A

United States Patent [19]

Li et al.

[11] Patent Number: 5,824,369

[45] Date of Patent: Oct. 20, 1998

[54] METHOD AND APPARATUS FOR COATING A TRAVELING PAPER WEB

[75] Inventors: Alfred C. Li, Napierville; Pamela K. Hynnek, Rockton, both of Ill.; James P. Alfano, Janesville, Wis.; Xuekui Lan, Roscoe, Ill.; Rex A. Becker, Janesville, Wis.

[73] Assignee: Beloit Technologies, Inc., Wilmington, Del.

[21] Appl. No.: 669,688

[22] Filed: Jun. 24, 1996

[51] Int. Cl.[6] ..... B05D 3/12; B05C 3/18

[52] U.S. Cl. ..... 427/345; 427/356; 118/602; 118/126; 118/410

[58] Field of Search ..... 118/410, 413, 118/126, 602; 427/356, 345

[56] References Cited

U.S. PATENT DOCUMENTS

| | | | |
|---|---|---|---|
| 4,396,648 | 8/1983 | Holt et al. | 427/356 |
| 4,405,661 | 9/1983 | Alheid | 427/356 |
| 4,452,833 | 6/1984 | Holt | 118/410 |
| 4,688,516 | 8/1987 | Sommer | 118/410 |
| 4,702,196 | 10/1987 | Kratzberger | 118/410 |
| 4,834,018 | 5/1989 | Sollinger et al. | 118/410 |
| 4,873,939 | 10/1989 | Eskelinen | 118/410 |
| 4,880,671 | 11/1989 | Sollinger et al. | 427/356 |
| 4,903,632 | 2/1990 | Sollinger | 118/123 |
| 4,920,913 | 5/1990 | Knop et al. | 118/410 |
| 4,945,855 | 8/1990 | Eklund et al. | 118/407 |
| 5,173,120 | 12/1992 | Suzumura et al. | 118/410 |
| 5,192,591 | 3/1993 | Chance | 118/410 |
| 5,354,376 | 10/1994 | Aidun | 118/410 |

*Primary Examiner*—Katherine A. Bareford
*Attorney, Agent, or Firm*—Dirk J. Veneman; Raymond W. Campbell; Gerald A. Mathews

[57] ABSTRACT

A method and apparatus for coating a traveling paper web includes a coating applicator disposed in movably-controlled spaced adjacency with the paper web, which is supported on a rotating backing roll. The coating applicator permits a controlled introduction of a fresh portion of an aqueous slurry of coating material which is mixed with a recirculated portion of coating material in a controlled manner to prevent the formation of large vortices within the coating applicator. The coating material flows successively through mixing, convergent, and recirculation channels, all of which are defined on one side thereof by a distinct surface of a flow stabilizer which is positioned centrally in a cavity in the coating apparatus. Control of the supply of the coating material through the inlet nozzle, and the recirculation of the coating material between the recirculation and mixing channels, through a recirculation nozzle, is effected by directing the coating material through a plurality of orifices which provide a controlled back pressure in the coating material as well as to disrupt the propagation of cross-machine vortices in the coating material. The paper web is brought into contact with the coating material along a convergent channel where the coating material is carried by the traveling web over the backing roll and where the flow variation in the coating material in the convergent channel is controlled at a small-scale level. A metering blade is positioned downstream of the convergent channel to bear against the coating over the web and meter the coating onto the traveling paper web.

8 Claims, 6 Drawing Sheets

METHOD AND APPARATUS FOR COATING A TRAVELING PAPER WEB

BACKGROUND OF THE INVENTION

1. Field of the Invention

This invention relates to a method and apparatus for coating a traveling paper web, which is frequently, but not always, done on a papermaking machine. More particularly, this invention relates to a method and apparatus for coating a traveling paper web utilizing a unique manner of recirculating and mixing a portion of an aqueous slurry, comprising a coating material, which coating material is brought into contact with the web in a convergent channel. Still more particularly, this invention relates to a method and apparatus for controlling the introduction of the coating material into the apparatus, and for the recirculation of the coating material about a flow uniformity stabilizer in the apparatus, by means of directing the aqueous coating material through a plurality of inlet and flow-metering orifices to create, maintain and control desired back pressure and flow stability within the coating material in the apparatus.

2. Description of the Prior Art

Coaters for coating paper, particularly blade-type coaters utilizing a flexible blade for metering coating on the paper web are well known in the coating and papermaking art. Examples of such coating apparatus are shown and described in U.S. Pat. Nos. 4,452,833 (Holt); 4,834,018 (Sollinger et al.); and 4,945,855 (Eklund et al.).

While these and other prior art methods and apparatus can coat paper adequately, and often very well, the problems associated with coating a traveling paper web have a genesis with most other paper production problems, that is how the job can be done in an exemplary manner at ever increasing speeds. Thus, a method and apparatus which functions very well at one machine speed may exhibit deficiencies at higher speeds, and these deficiencies always affect the quality and uniformity of the coating process and coated paper product.

In coating a traveling paper web at high speed, two major problems are streaking and skipping. Streaks appear spaced apart in the cross-machine direction and are manifested by non-uniformities in the weight of the coating material which results in a undesirable, visible streak of coating on the paper web extending in the machine direction.

Streaking is usually caused by unstable vortices that create velocity and pressure differentials along the length of the metering blade which is arrayed in the cross-machine direction. The non-uniform hydraulic force of the aqueous coating material causes localized deflections in the flexible blade which, in turn, permit a greater amount of coating material to pass between the locally-deflected portion of the blade and the paper web passing beneath the blade. The excess coating material passing through such a deflection gap creates the undesirable streak.

Skipping is a machine-direction non-uniformity in the application of the coating material to the paper web. The coating material varies in thickness in the machine direction such that in some places on the paper web, there is little or no coating, while in other places of the traveling paper web, there is more coating than is desirable.

Skipping can be caused by momentary, localized hydraulic pressure pulses, or insufficient coating flow, against the blade produced by variations in the pressure or flow of the aqueous coating material. The pulse deflects the blade away from the traveling paper web for a very short time interval. This permits a relatively thick spurt of coating material to quickly pass beneath the blade. When the momentary pressure pulse has subsided, the resilient force of the deflected portion of the metering blade causes the blade to snap back toward the traveling paper web and the dynamic force of such motion causes the blade to force the coating material immediately beneath it away such that the portion of the web in that location is inadequately coated, or possibly not coated at all, thereby producing the undesirable skipping pattern of the coating on the paper web extending in the direction of web travel.

As machine speeds (i.e., the speed of the papermaking machine and the paper web it produces) increase, the dynamics associated with the introduction of the aqueous coating material into the coating apparatus, and the uniformity of the flow of the coating material in both the cross-machine and machine directions, becomes harder to control and make consistent in order to produce a high quality coated paper product.

Various attempts to speed the movement of the coating material through the coating apparatus have all produced undesirable results at successively higher machine speeds. Such failures are caused by the creation of localized flow/pressure differentials, lateral fluid movement, and the failure to control large-scale vortices in the aqueous slurry of material as the flow of coating material has been increased to meet the desired coating speeds. For example, at a given coating speed, there might not be any problem with lateral flow of the coating material, but there may well be vortices created in the coating material which might create skipping. At another coating speed, there might not be deleterious vortices created, but there might be sufficient lateral pressure differentials to cause streaking in the coated web.

Thus, there is an on-going need to create better dynamic balance in the parameters affecting uniformity of the flow of the aqueous coating material in the coater head to produce high-quality coated paper at high machine speeds, such as, for example, 5,000 feet per minute, or higher.

SUMMARY OF THE INVENTION

The deficiencies of coating a traveling paper web at high speeds with a high-quality coating have been obviated by this invention. In this invention, a relatively large cavity is formed in the coating applicator. This cavity is bounded by a backing roll, a metering blade, an upper portion of a coater head and a baffle. Interposed within this cavity, and mounted on the coater head, is a flow stabilizer having a plurality of flow-metering orifices extending through its lower portion. These orifices, in a preferred embodiment, take the form of a plurality of holes, the plurality aligned in spaced adjacency extending in the cross-machine direction. Collectively, these flow-metering orifices form a recirculation nozzle.

The flow stabilizer is shaped to have distinct surfaces which combine with surfaces of a baffle, the paper web supported over the backing roll, and the metering blade to form mixing, convergent and recirculation channels. These three channels, together with the flow-metering orifices extending through the flow stabilizer, form a loop for recirculated coating material to flow in a direction such that, in the convergent channel, the coating material flows in the same direction as the web travels as it is supported against the backing roll.

A similar set of inlet orifices, which also comprise, in a preferred embodiment, a plurality of holes, the plurality aligned in spaced adjacency extending in the cross-machine direction, are formed in the coater head such that they collectively form an inlet nozzle through which fresh coating material flows from a supply chamber into the bottom of the mixing chamber.

The coating material flowing into the mixing chamber from the inlet orifices impinges against the baffle and flows upwardly in the mixing chamber between the baffle and the upstream surface of the flow stabilizer. The recirculation orifices in the stabilizer direct the recirculating coating material into the mixing chamber at an obtuse angle to the fresh coating material flowing upwardly in the mixing chamber.

At the top of the mixing chamber, a relatively larger portion of the coating material flows backwardly, upstream, over the baffle, and out of the coating applicator, while a relatively smaller portion flows into a convergent channel between a distinct surface of the flow stabilizer and the paper web supported over the backing roll. The coating material is pulled along in the convergent channel by its contact with the paper web surface to be coated.

Excess coating material flows out of the small end of the convergent channel and into a recirculation channel from which it is gathered at a lower location in the recirculation channel to be directed into the orifices of the recirculation nozzle to be mixed with the fresh coating material in the mixing chamber.

A metering blade extends along the downstream side of the recirculation channel and bears against the coating over the traveling paper web in spaced adjacency with the small end of the convergent channel to meter the coating from the paper web.

By having distinct, substantially spaced apart surfaces on the flow stabilizer, which form a continuous peripheral surface for the outer surface of the stabilizer which is not mounted on the coater head, and which cooperate with the baffle, paper web supported against the surface of the backing roll, and the metering blade, the coating applicator provides a substantial cavity for holding a relatively large volume of coating material to provide the volume of coating material necessary to coat a paper web traveling at relatively high speeds, such as about 5,000 feet per minute, or greater. To balance the dynamics associated with the flow of such a relatively large volume of coating material, there are also provided mixing, convergent and recirculation channels which are still narrow enough to mitigate the propagation of large-scale vortices, which are deleterious to the desired high speed coating.

In addition, the inlet and flow-metering orifices, which collectively comprise the inlet and recirculation nozzles, respectively, permit the desired quantity of flow while controlling lateral, cross-machine flow of the coating material, and back pressure levels in the supply chamber and recirculation channel, as well as the mixing of the fresh and recirculated coating materials in the mixing channel. This control of the pressure and cross-machine and machine directions of the coating material permit the coating applicator to apply the coating material uniformly to the traveling paper web in the cross-machine direction at relatively high speeds while effectively changing large-scale vortices, disturbances, or non-uniformities, into small-scale, thereby controlling the disturbances, or flow stability, in the coating material in each of the channels within the coating applicator to optimize the combination of machine speed and quality and consistency of the coating process.

At any given instant, the uniformity of the vortex geometry is highly variable, and the location of any segment of the vortex is highly unpredictable, and yet their control is central to high-speed coating. This invention provides such control of the coating material flow at high speeds.

Accordingly, it is an object of this invention to provide a method and apparatus for improving the paper web coating process at high speeds.

Another object of this invention is to provide a method and apparatus for coating a traveling paper web where flow instabilities in the supply of the aqueous coating material are kept further from the metering blade.

Still another object of this invention is to provide a method and apparatus for coating a traveling paper web wherein the effects of any vortices formed in the coating material are reduced to prevent the vortices from having a deleterious effect on the coating process.

A feature of this invention is the provision of a flow stabilizer having distinct surfaces which cooperate with surfaces on other components to form a plurality of flow channels within the coating apparatus.

Another feature of this invention is the provision of inlet orifices and flow metering orifices to control back pressure (i.e., provide a desired pressure level), lateral flow of the coating material, and the mixing of the recirculated and fresh portions of the coating material.

These, and other objects, features and advantages of the method and apparatus of this invention will become readily apparent to those skilled in the art upon reading the description of the preferred embodiments in conjunction with the attached drawings.

DESCRIPTION OF THE PREFERRED EMBODIMENT

Figure 1:
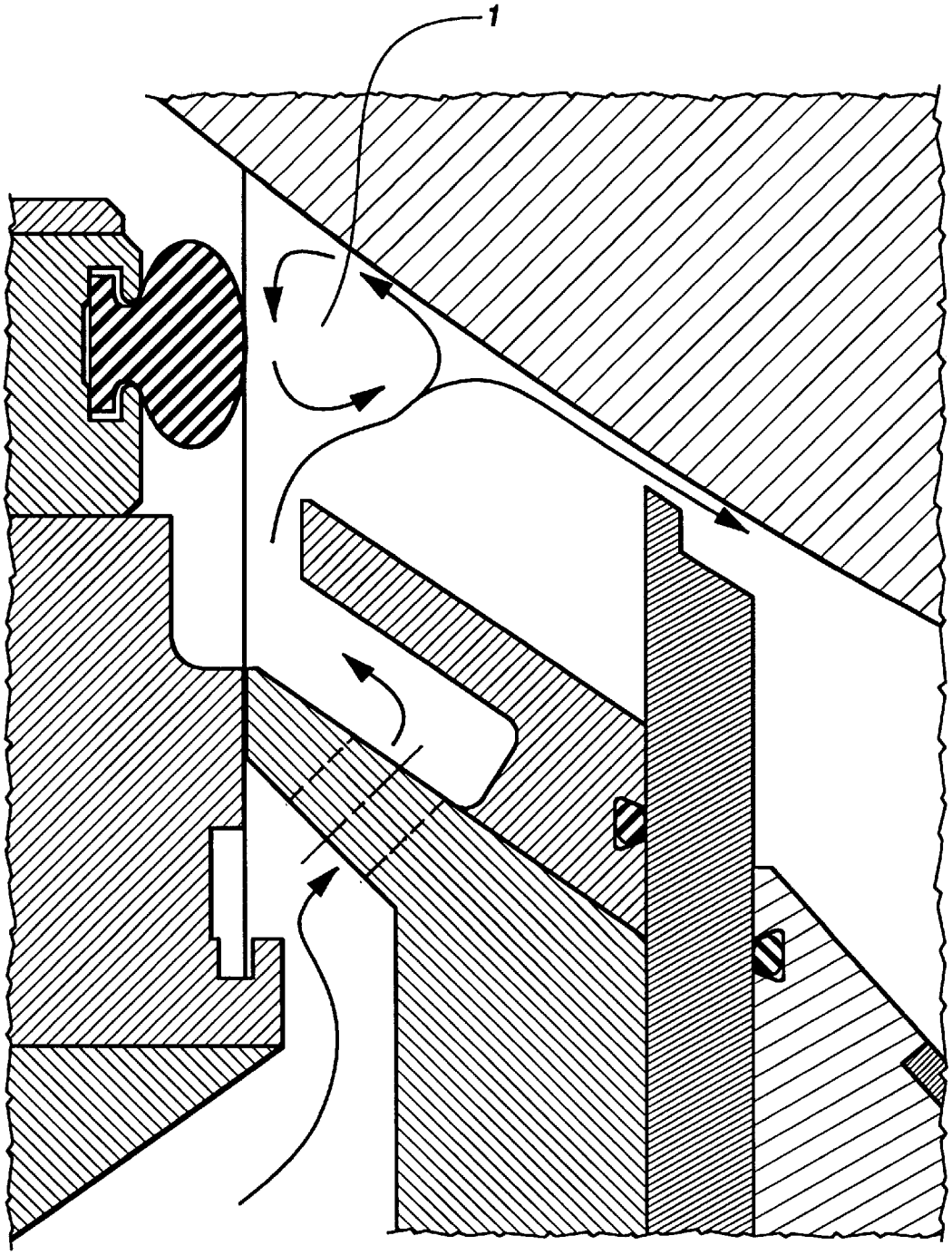
Fig.1 (PRIOR ART)
FIG. 1 is a cross-sectional, side-elevational view of a prior art coater of a type known as a so-called "short-dwell" coater.
Figure 2:
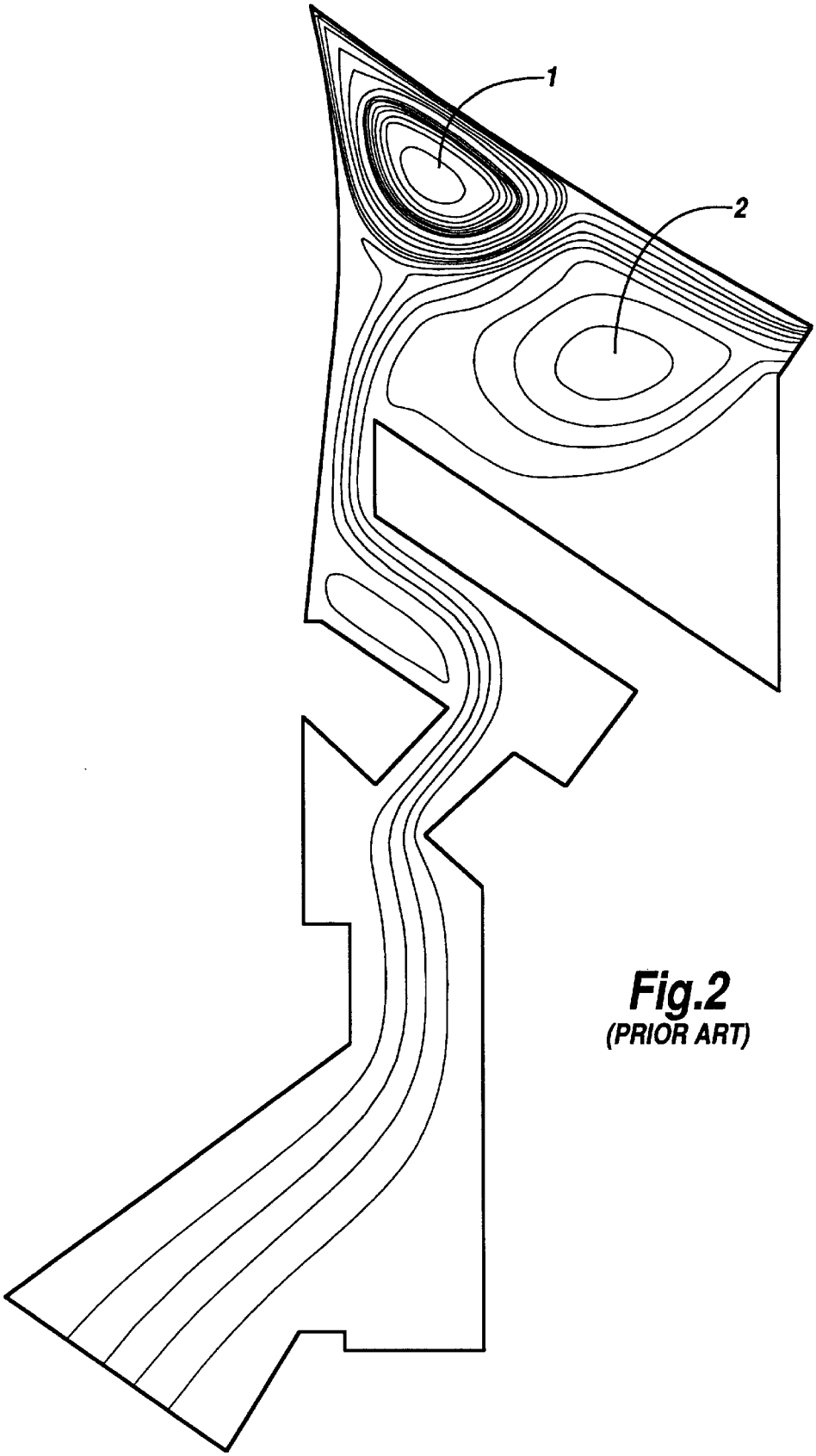
Fig.2 (PRIOR ART)
FIG. 2 is a corresponding view of the same coater shown in FIG. 1 and showing the stream-flow lines of the coating material forming a pair of large-scale vortices in the coating applicator.

In order to better understand the significance of the invention, the prior art, as exemplified in FIGS. 1 and 2, will be discussed first. FIGS. 1 and 2 illustrate a so-called "short-dwell" type coater wherein the time during which the coating material is exposed to the traveling paper web (i.e., the "dwell") is intended to be short in order to permit higher coating speeds without generating high hydraulic forces associated with moving substantially large quantities of aqueous coating material against the web and through the coating applicator. In the short-dwell-time type of coater, or coating applicator, the pond of coating material is relatively deep and relatively short in the direction of web travel. Such a configuration permits the formation of relatively large vortices, generally designated 1 and 2 in FIGS. 1 and 2.

In the paper industry, coating material is an aqueous slurry of material, or mineral, including pigment and/or clay, such as kaolin, which is commonly used for coating paper, such as magazine paper.

In this description, a prime mark (') is used to designate either the same element or measurement, but in a different position, or a plurality of items designated with the same number.

Thus, while the coating material is introduced into the coater head in a convoluted path to promote mixing and the breakup of air bubbles and vapor, the apparatus also permits the formation of relatively large vortices. These vortices do not necessarily represent a problem until the coating speeds exceed a certain range. Stated another way, vortices per se are not necessarily undesirable, and they can even be useful under certain conditions, but their size and control can and does become a problem eventually as the coating speed (i.e., speed of the traveling paper web) exceeds a certain level. At that certain top speed, the stability of the vortex degrades and will cause instabilities in the aqueous coating material, such as, for example, momentary and local variations in the coating material flow rate in the machine and cross-machine directions, and pressure pulsations.

Figure 3:
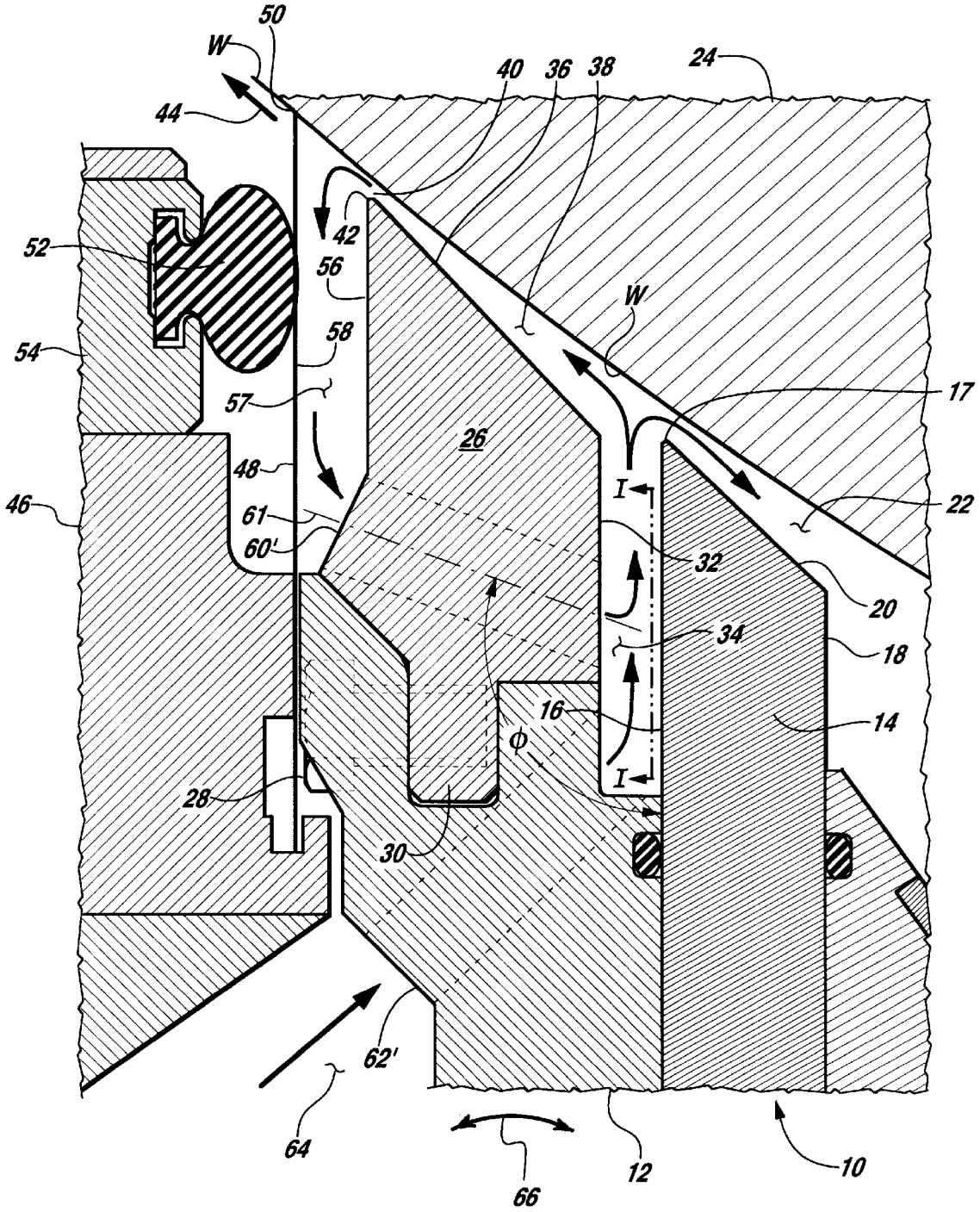
FIG. 3 is a cross-sectional, side-elevational view of the coating applicator of this invention.

With reference to FIG. 3, in this invention, a coating applicator, generally designated with a numeral 10, includes a coater head 12 in which a substantially linear extending baffle 14 is mounted. This baffle has two, parallel sides or surfaces 16, 18, which extend upwardly, as shown in FIG. 3, and an upper, beveled side 20 disposed at an angle to the surfaces 16, 18 connects the two parallel sides, and also forms an overflow gap 22 between the upper side 20 of the baffle and the outer surface of the traveling paper web W supported on the surface of backing roll 24. Beveled side 20 forms a distal end, or edge, 17 with inner surface 16.

A flow stabilizer, or flow uniformity stabilizer, 26 is shown, in the preferred embodiment, replaceably mounted on the coater head by means of a plurality of cap screws 28 which extend through a lower flange 30 in the flow stabilizer and into the coater head. The flow stabilizer has several distinct surfaces, including surface 32 which is in opposed, spaced adjacency with the innermost surface 16 of the baffle so as to define between the baffle and the stabilizer a mixing channel 34.

At the top of the flow stabilizer is a slanted surface 36 which, in conjunction with the outer surface of the paper web W supported on the backing roll, forms a convergent channel 38 having a larger opening toward the mixing channel and a narrow gap 40 formed between a lip 42 at the downstream end of the convergent channel over the web W.

Near the downstream end of the flow applicator, in the direction as indicated by the arrow 44, in which the traveling paper web W is moving, is a blade clamping bracket 46 which holds a flexible metering blade 48 against the coater head. The metering blade is disposed to have its beveled distal tip, or edge, 50 engaging the paper web and pressing the paper web against the backing roll. An inflatable tube 52 is mounted in a tube holder 54 mounted on the blade clamping bracket for loading and maintaining the blade in engagement with the paper web at a desired position and with a desired force. This is accomplished by inflating the air tube 52 to a desired pressure in a manner which is well known in the art.

The metering blade is in spaced, substantially parallel, adjacency with another distinct surface 56 on the flow stabilizer and thereby forms, with an inner surface 58 of the metering blade, a recirculation channel 57 which extends away from the surface of the traveling web, which is exposed to the top of the recirculation channel. Near a lower portion of the surface 56 of the flow stabilizer which, in this embodiment, is shown extending at a slight angle outwardly from the plane of the upper portion of the surface 56 of the flow stabilizer, are a plurality of orifices 60, which preferably take the form of drilled holes or perforations in the flow stabilizer.

These orifices function as flow metering orifices, as will be explained later, and extend from the recirculation channel to the mixing channel. Collectively, they function as a recirculation nozzle 60' which controls important parameters, such as back pressure, or pressure level, and lateral flow, for example, of the flow of the aqueous coating material between these channels.

Similarly, a plurality of inlet orifices 62 are formed in the coater head and extend from a supply chamber 64, in which the aqueous coating material is introduced into the coater, to a lower portion of the mixing channel 34. These inlet orifices are collectively referred to as the inlet nozzle 62' and control important parameters in the same manner as the flow metering orifices.

Figure 3A:
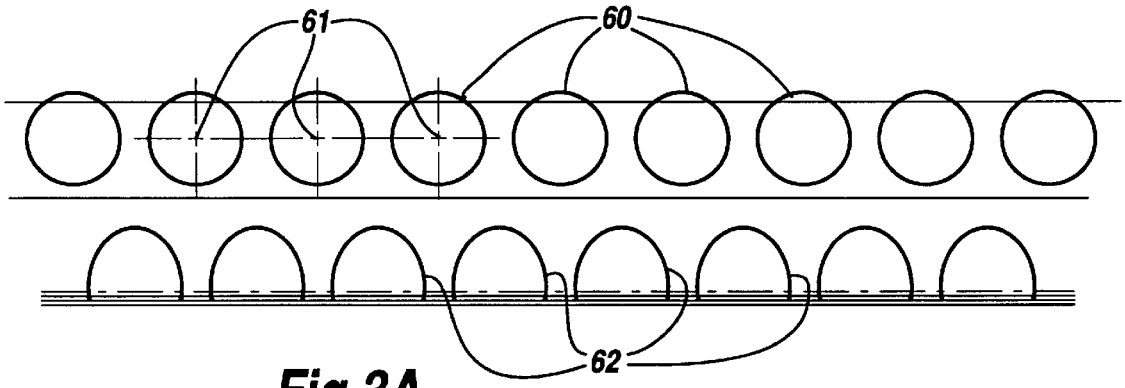
FIG. 3A is a front view of the inlet and flow-metering orifices as shown in view I—I in FIG. 3.

Both the flow metering orifices 60 and the inlet orifices 62 are shown in front elevation in FIG. 3A.

Figure 5:
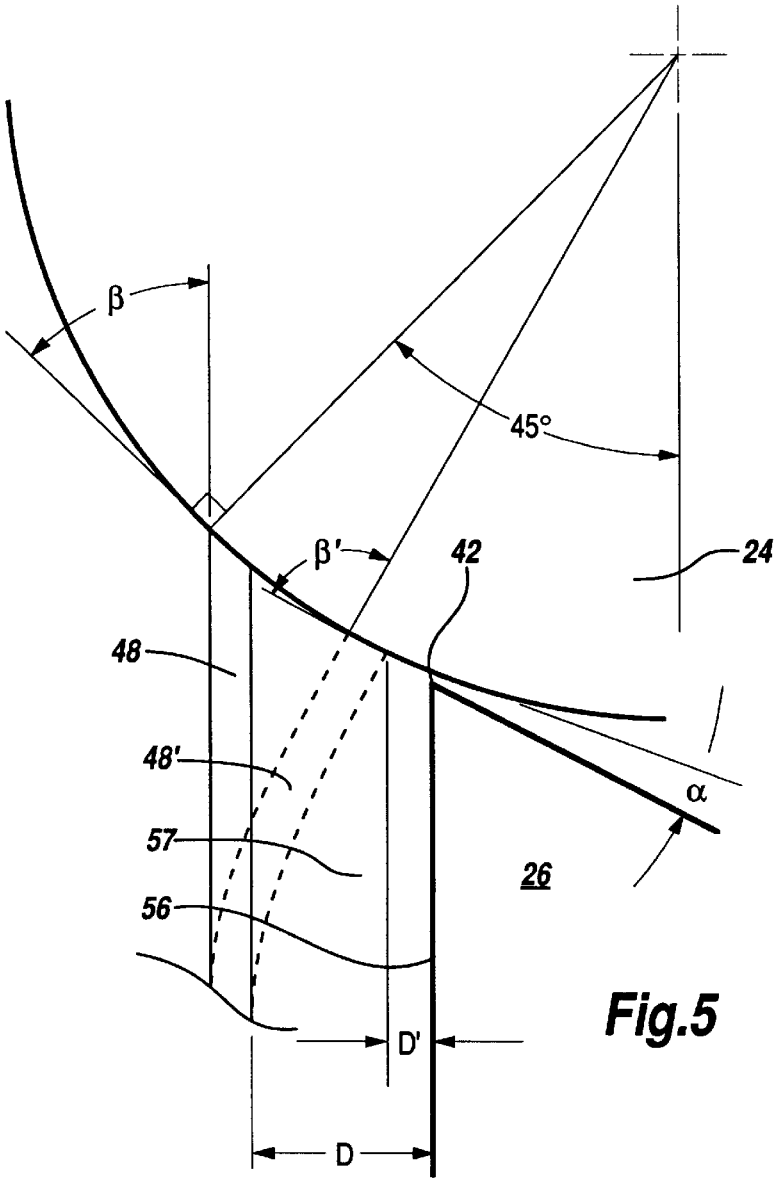
FIG. 5 is a side view showing the change in position of the metering blade relative to the tip of the flow stabilizer during operation of the coating apparatus as the tip of the metering blade wears away.

Referring to FIG. 5, the angle of convergence $\alpha$ between the surface 36 on the flow stabilizer and a tangent line at the point on the web opposite the lip 42 is preferably about 8°. The gap 40 might typically range from 0.035 inch to about 0.090, or possibly about 0.10, inch, for example.

In operation, with reference to FIG. 3, the traveling paper web W is held by tension to be supported against backing roll 24 which rotates to move the web in the direction of arrow 44. An aqueous slurry comprising the coating material is introduced into supply chamber 64 from outside the machine by means of a pump. This pump and supply method and apparatus are well known in the coating and papermaking art, so they will not be described further.

The pressurized coating material is introduced into the inlet nozzle 62' and flows into the mixing channel 34 via the plurality of individual inlet orifices, or holes 62, which extend uniformly in the cross-machine direction as shown in FIG. 3A. This flow of fresh coating material impinges against the inner surface 16 of the baffle and is directed upwardly, as shown in FIG. 3, in the mixing chamber.

In this description, with reference to the drawings, particularly FIGS. 1 and 3, the flow of the coating material is shown by the non-numerically designated arrows.

When the mixture of recirculated and fresh coating material reaches the top of the mixing channel, as shown in FIG. 3, the pressure in the convergent channel 38 causes a large portion, such as for example, about 95%, of the mixed coating material to overflow backward, or upstream, over the distal end, or edge, 17 and the slanted, or beveled, surface 20 of the baffle 14. This portion of overflow coating material is subsequently recycled into the supply chamber. Flow over surface 20 of the baffle effectively establishes a hydraulic seal to help prevent the web from dragging air into the coating applicator.

The mixed recirculated and fresh coating enters the convergent channel 38 representing approximately 3 to 5 times the volume of coating entering the applicator via the inlet orifices, where the pressure created by the convergence of surface 36 and the surface of the traveling paper web causes the coating material to be applied to the paper web and be carried by the surface of the paper web. When the coating material passes over the edge of the lip 42 of the flow stabilizer, even though the hydraulic pressure in the recirculation channel 57 is somewhat higher than atmospheric pressure, the relative pressure differential between the higher pressure near the blade tip and the relatively lower pressure in the recirculation channel cause most of the coating material to flow downstream toward the flow metering orifices 60 in the recirculation channel. The flow-metering orifices help maintain this slight overpressure in the recirculation channel.

In a manner similar to the flow of fresh coating material into the coating applicator, a flow of recirculating coating material travels downwardly in recirculation channel 57 and is introduced into the flow metering orifices, or holes 60 in the flow stabilizer and flow through the flow metering orifices to the mixing channel 34. This recirculating flow is also uniform in the cross-machine direction as shown by the uniformly aligned orifices 60 shown in FIG. 3A. The flow of recirculating coating material impinges the flow of the fresh coating material flowing parallel to the baffle in the mixing channel at an obtuse angle $\phi$ which, in FIG. 3, is shown for purposes of illustration as being between the center line 61 of the flow metering orifices, or nozzle 60', and the surface 16 of the baffle, which is parallel to the flow of fresh coating material.

The tip 50 of the metering blade 48, which blade is shown slightly bowed in line 48' in FIG. 5, contacts the coating material carried by the web and meters the coating material such that the coating material passing past the beveled edge of the metering blade is uniform and continuous in both the cross-machine and machine directions.

Even though fresh coating material is continuously entering the mixing chamber, the recirculating portion of coating material entering the flow metering nozzle 60' from the recirculation channel is about 3 to 5 times the volume of the supply of fresh coating material entering the mixing channel via inlet nozzle 62'. Recirculation permits the use of smaller pumps, or permits pumps to be operated slower, both options requiring less energy or capital expenditure.

Figure 4:
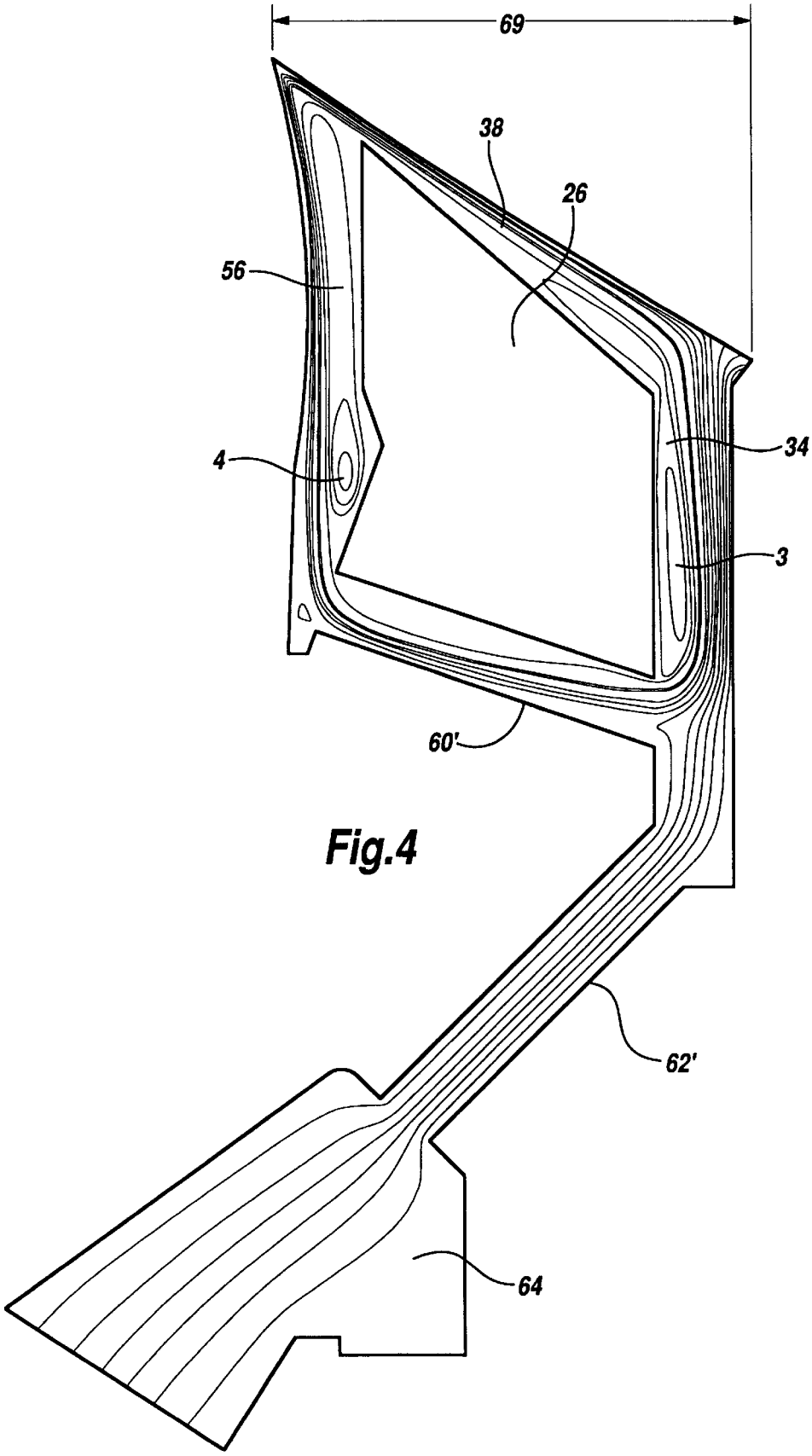
FIG. 4 is a side-elevational, cross-sectional view of the coater of this invention shown in FIG. 3 and showing the stream-flow lines of the coating material within the coating applicator of this invention.

With reference to FIG. 4, it is seen that the stream flow lines of the coating material, produced by a computer model simulation, do not form large vortices, particularly when compared with the similar computer model simulation shown in FIG. 2, which represents a prior art coating applicator configuration. This is due to the fact that the flow stabilizer 26 has been positioned in the space which would otherwise be occupied by the eye of a large vortex. The vortices 3, 4 shown in FIG. 4, are small in diameter and, therefore, do not deleteriously affect either the localized or overall flow of the coating material in the various mixing, convergent and recirculation channels. Also, and at least equally important, the flow stabilizer causes the location of the vortices to be moved further away from the point of application, so their effects are reduced.

With reference again to FIG. 5, preferably the bevel angle $\beta$ at the tip of the metering blade is about 45°. However, as the metering blade wears during operation, the bevel angle increases as the metering blade wears and the tip migrates upstream closer to the lip 42 of the flow stabilizer. However, the tip of the metering blade never gets closer to the lip 42 than a predetermined distance. The apparatus is designed, therefore, such that the metering blade will not contact the flow stabilizer, but will always remain in spaced adjacency with the lip of the flow stabilizer so as to maintain the recirculation channel open. The metering blade will be replaced, or adjusted, when the bevel angle $\beta'$ approaches 90°, or prior to its closing off the recirculation channel.

Figure 6:
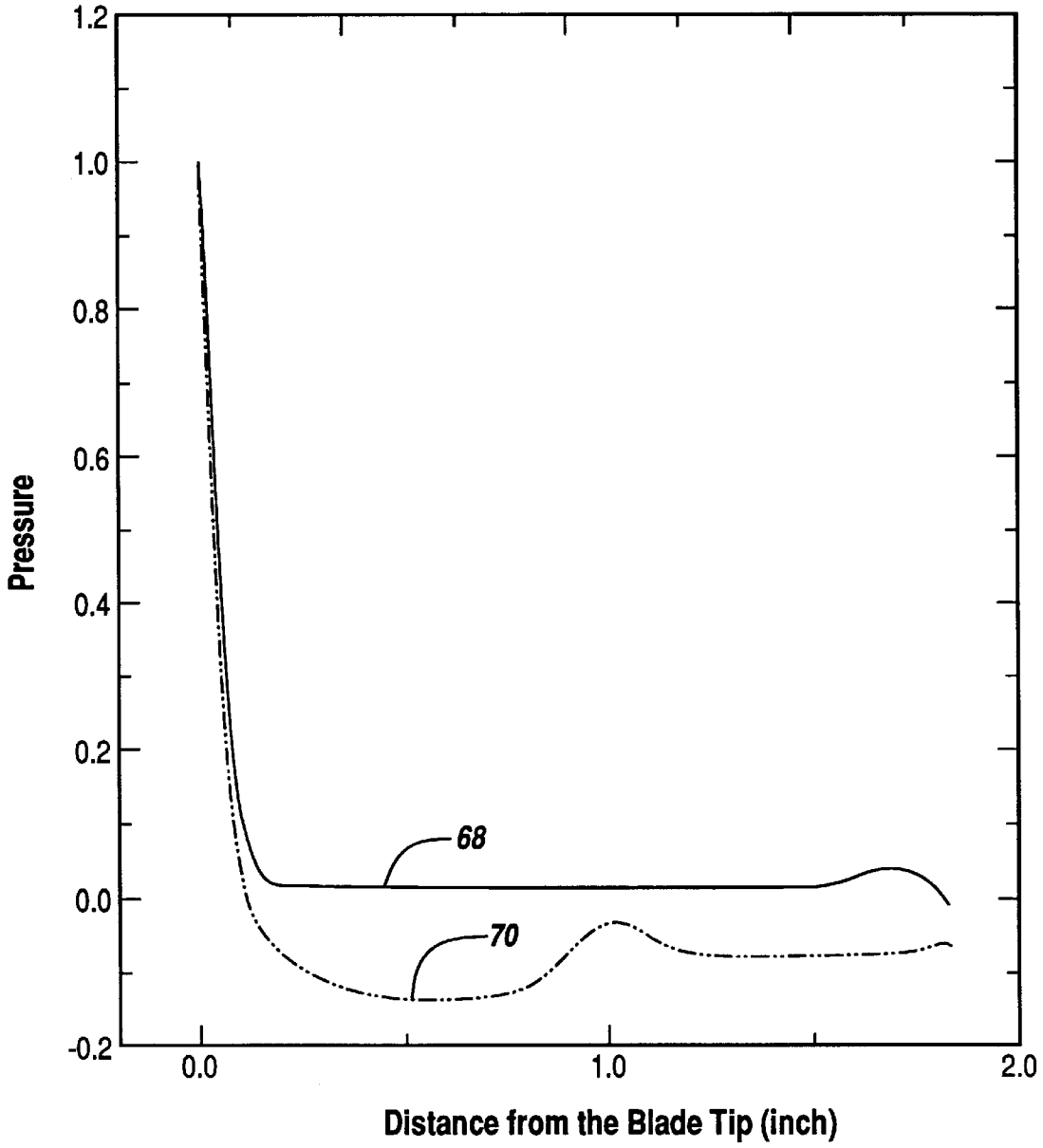
FIG. 6 is a graph showing a comparison between the relative pressure levels of a so-called "short-dwell" type coater and the coater of this invention, and showing the relative pressure of the coating material against the paper web supported on the backing roll as a function of the distance from the tip of the metering blade upstream toward the flow stabilizer and over its converging top surface.

With reference to FIG. 6, a comparison of the pressure on the paper web between the tip 50 of the metering blade and the baffle 20 between the coater of this invention, shown in solid line 68, and a so-called short-dwell type coater, shown in dashed line 70, is shown. There are no units for the pressure ordinate because this graph is intended to illustrate a comparison, not to show absolute pressures. The horizontal span of the pressure 68 on the paper web is shown as distance 69 in FIG. 4. The significant aspect is that the coating operation of this invention produces a substantially stable, uniform pressure over the entire distance between the blade tip and the baffle, and thereby functions to reduce air entrainment, whereas the hydraulic pressure produced in the corresponding location in the short-dwell type coater is below ambient pressure and is not uniform for the entire distance. There is no significant pressure spike in this location in this invention. Negative pressure regions for the dashed line (short-dwell coater) coincide with the location of vortices shown in FIG. 2.

By means of configuring both the inlet nozzle and the recirculation nozzle as comprising a plurality of uniformly sized and spaced orifices extending for the entire effective cross-machine width of the coating applicator, the back pressure, or pressure level, in the supply chamber and recirculation channel can be controlled. Further, the uniform flow through the orifices acts to control or collapse any large-scale vortices which might otherwise form, or to interrupt any laterally extending vortices or lateral flow of coating material in the cross-machine direction. Flow through the orifices also breaks up, or speeds the break-up, of air or vapor entrained in the coating material, which further enhances the quality of the coating material applied to the paper web. Thus, the uniformly spaced and sized orifices have a beneficial effect in both vortex and lateral fluid flow control. This permits the coating material to remain stable in a laminer-flow sense, at higher machine/coating speeds.

In addition, the off-set configuration of the flow metering orifices extending between the recirculation and mixing channels, and the inlet orifices, extending between the supply chamber and the mixing channel, as shown in FIG. 3A, promote more uniform mixing as well as lateral stabilization of the mixed constituencies.

With reference to FIGS. 3 and 5, during the operation of the coating apparatus, as the metering blade wears, in order to maintain the bevel angle $\beta$ between the metering blade and the paper web being coated, the coating applicator can be rotated by means, such as, for example, an actuator shown schematically as double headed arrow 66, to increase the convergence angle $\alpha$ from about 8° to about 11°. This would have the concomitant effect of maintaining the effective depth D, D' of the recirculation channel to be within an acceptable range to permit the desired amount of recirculation of the coating material, as well as to maintain the location of the "split" between the recirculating portion of the coating material passing over the tip 42 of lip 38 of the flow stabilizer, and the coating applied to the web, at a desired distance upstream of the location where the metering blade contacts the paper web being coated.

If desired, the flow stabilizer can be rotated the other direction, that is, counterclockwise as shown in FIG. 3, to decrease the convergence angle α by about 3°. This would operate to maintain the metering blade in a desired position relative to the lip of the flow stabilizer for a longer period of time. Thus, the convergence angle α might range from about 5° to about 11° in operation.

The flow stabilizer also operates to break-up large-scale vortices, and maintain desirable small-scale vortices, by being positioned in the "eye", so to speak of the central cavity between the inside surface 58 of the metering blade, a lower portion of the coater head, the inside surface 16 of the baffle, and the outer surface of the paper web over the backing roll. Such a configuration provides an optimal combination of volume for maintaining a relatively substantial amount of coating material in the coating applicator, as well as providing the desired control of the vortices and flow of the coating material within the coating applicator.

It is envisioned that changes in both the method and apparatus of this invention can be made within the spirit and scope of the invention. For example, terminology used in describing the invention is used in its descriptive sense and not by way of limitation. Thus, for example, the term "distinct" is used in describing a surface used in association with another surface in the context of defining a channel and not necessarily the end boundaries of a particular surface. Also, while there are parameters associated with the invention that have been described numerically, by way of example, the invention is not intended to be limited by the explicit numbers recited, but only by the scope of the claims.

What is claimed is:

1. A method of coating a traveling paper web, having a predetermined width, with a film of coating material having a weight per unit area of web, the method utilizing a rotatable backing roll for supporting the paper web, a coating applicator having an operating width extending in the cross-machine direction for at least the effective width of the traveling paper web, the coating applicator including a coater head, a metering blade for metering the weight of coating film remaining on the web after the coating has been applied to the web, a baffle having a distal end for directing one portion of coating material onto the traveling web, and for permitting another portion to fall away from the traveling web, and a flow stabilizer having a converging lip, the flow stabilizer providing distinct surfaces in proximity to 1) the baffle, 2) the web over the backing roll, 3) the metering blade, to define therewith corresponding mixing, convergent and recirculation channels, respectively, the method comprising the steps:

1) introducing a flow of fresh coating material via an inlet nozzle into the mixing channel, and against the baffle, for substantially the width of the traveling web at a location upstream of where the baffle directs a portion of the coating material against the traveling web;

2) controlling the flow of coating material through the inlet nozzle by directing the coating material through a plurality of inlet orifices which comprise the inlet nozzle;

3) directing the flow of coating material downstream into the mixing channel to the web supported on the backing roll;

4) splitting the flow of coating material proximate the distal end of the baffle of the mixing channel into a larger portion, which is directed to flow upstream over the baffle and out of the coating applicator, and a smaller portion, which flows downstream against the traveling web, and is carried downstream by the traveling web;

5) directing the smaller portion into the convergent channel extending and converging in the direction of web travel, the convergent channel having a convergent angle and ending in a converged gap between the converging lip and the web supported on the backing roll, and in upstream spaced adjacency with the metering blade, whereby some coating material is urged against, and is carried by, the web to the metering blade;

6) dividing the portion of coating material passing the flow stabilizer lip into film and recirculating portions, the film portion carried by the traveling web past the metering blade for coating the traveling paper web, and the recirculating portion passing into the recirculation chamber;

7) directing the recirculating portion of the coating material into a plurality of flow-metering orifices, disposed in spaced adjacency in the flow stabilizer and extending substantially for the effective width thereof, the orifices extending longitudinally between the recirculation and mixing chambers, and entering the mixing chamber by being projected thereinto to intercept the oncoming flow of the fresh coating material at an obtuse angle relative to the direction of the oncoming flow of coating material in the mixing channel, whereby the recirculating portion and fresh coating material are mixed in an improved manner and control of vortices in the coating material is promoted.

2. A method of coating a traveling paper web, as set forth in claim 1, wherein:

the directing of the flow of the coating material into the mixing chamber from the inlet orifices, and the directing of the flow of coating material into the mixing chamber from the flow-metering orifices is such that the flow from successive orifices, extending in the cross-machine direction, is from alternating inlet and flow-metering orifices, whereby control of the mixing of the recirculating and fresh portions of coating material is maintained in the cross-machine direction.

3. A method of coating a traveling paper web, as set forth in claim 1, further including the steps of:

creating a hydraulic pressure in excess of atmospheric pressure in the recirculation channel.

4. Apparatus for coating a traveling paper web with a film of coating material, the paper web supported on the surface of a rotatable backing roll with the surface of the paper web to be coated facing outwardly from the backing roll, the apparatus comprising, in combination:

a coating applicator which is movably mounted relative to the backing roll, the coating applicator including a coater head, and a metering blade;

metering blade loading means for loading the metering blade against the paper web over the backing roll relative to the bracket;

a flow stabilizer mounted in the coating applicator in a fixed position relative to the coater head, the flow stabilizer having a plurality of distinct surfaces;

a baffle mounted in the coating applicator in a fixed position relative to the coater head, the baffle having a distal end, and substantially defining, with a first distinct surface of the flow stabilizer and an inner surface of the baffle, a mixing channel extending toward the distal end of the baffle;

a second distinct surface of the flow stabilizer extending from the first distinct surface near the distal end of the baffle in the direction of the traveling web, and defining, with the opposed outer surface of the paper web supported on the backing roll, a convergent channel which is in fluid communication with the mixing channel;

a third distinct surface on the flow stabilizer extending from the second distinct surface, and substantially defining, with the metering blades a recirculation channel in fluid communication with the convergent channel;

a flow metering nozzle, including a plurality of orifices in the flow stabilizer for providing fluid communication, in the form of a directed flow of coating material, from the recirculation channel and into the mixing channel;

an inlet nozzle, including a plurality of orifices in the coating apparatus for providing fluid communication, in the form of a directed flow of coating material between a flow of coating material in the mixing channel from a source of fresh coating material and the directed flow of coating material from the recirculation channel into the mixing channel;

the flow metering and inlet nozzles being so constructed and arranged that directed flows through the flow metering and inlet orifices converge in the mixing chamber such that their mutual angle of impingement is obtuse, whereby improved mixing and control of vortices in the coating material in the apparatus is promoted.

5. Apparatus for coating a traveling paper web, as set forth in claim 4, wherein:

the flow metering and inlet orifices each comprise a plurality of holes through the flow stabilizer and coating apparatus, respectively, each of the plurality of holes having orifices aligned in the cross-machine direction.

6. Apparatus for coating a traveling paper web, as set forth in claim 5, wherein:

the inlet orifices are in the coater head.

7. Apparatus for coating a traveling paper web, as set forth in claim 5, wherein:

the plurality of flow metering orifices, and the plurality of inlet orifices, are aligned such that successive orifices in the cross-machine direction alternate between flow-metering and inlet orifices.

8. Apparatus for coating a traveling paper web, as set forth in claim 5, wherein:

the location of the aligned flow-metering orifices in the mixing chamber is downstream of the location of the entry of the inlet orifices in the mixing chamber.

* * * * *